US008187079B2

(12) United States Patent
Gomez et al.

(10) Patent No.: US 8,187,079 B2
(45) Date of Patent: May 29, 2012

(54) GAMING SYSTEM WITH PATTERNED ENHANCEMENT FEATURES

(75) Inventors: Benjamin T. Gomez, Chicago, IL (US); Jeremy M. Hornik, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 500 days.

(21) Appl. No.: 12/420,485

(22) Filed: Apr. 8, 2009

(65) Prior Publication Data

US 2009/0253491 A1 Oct. 8, 2009

Related U.S. Application Data

(60) Provisional application No. 61/123,322, filed on Apr. 8, 2008.

(51) Int. Cl.
*A63F 9/24* (2006.01)

(52) U.S. Cl. ..... 463/20

(58) Field of Classification Search ..... 463/20
See application file for complete search history.

(56) References Cited

U.S. PATENT DOCUMENTS

| | | | | |
|---|---|---|---|---|
| 5,580,053 | A | 12/1996 | Crouch | 463/20 |
| 5,980,384 | A | 11/1999 | Barrie | 463/16 |
| 6,089,977 | A | 7/2000 | Bennett | 463/20 |
| 6,251,013 | B1 | 6/2001 | Bennett | 463/13 |
| 6,280,328 | B1 | 8/2001 | Holch et al. | 463/42 |
| 6,290,600 | B1 | 9/2001 | Glasson | 463/20 |
| 6,419,579 | B1 | 7/2002 | Bennett | 463/20 |
| 6,439,993 | B1 | 8/2002 | O'Halloran | 463/16 |
| 6,517,432 | B1 | 2/2003 | Jaffe | 463/16 |
| 6,517,433 | B2 | 2/2003 | Loose et al. | 463/20 |
| 6,561,900 | B1 | 5/2003 | Baerlocher et al. | 463/20 |
| 6,565,433 | B1 | 5/2003 | Baerlocher et al. | 463/20 |
| 6,585,264 | B2 | 7/2003 | Benett | 273/143 R |
| 6,786,818 | B1 | 9/2004 | Rothschild et al. | |
| 6,805,349 | B2 | 10/2004 | Baerlocher et al. | 273/138.2 |
| 6,866,583 | B2 | 3/2005 | Glavich et al. | 463/20 |
| 6,875,106 | B2 | 4/2005 | Weiss et al. | 463/20 |
| 6,881,146 | B2 | 4/2005 | Anderson et al. | |
| 6,981,635 | B1 | 1/2006 | Hughes-Baird et al. | 235/375 |
| 6,997,808 | B2 | 2/2006 | Rodgers et al. | 463/30 |
| 7,040,985 | B2 | 5/2006 | Vancura | 463/20 |
| 7,070,502 | B1 | 7/2006 | Bussick et al. | 463/20 |
| 7,195,559 | B2 | 3/2007 | Gilmore et al. | 463/20 |
| 7,237,775 | B2 | 7/2007 | Thomas et al. | |
| 7,252,592 | B2 | 8/2007 | Rodgers et al. | 463/30 |
| 7,396,279 | B2 | 7/2008 | Berman et al. | 463/16 |
| 7,559,837 | B1 | 7/2009 | Yoseloff et al. | 463/21 |
| 7,758,414 | B1 | 7/2010 | Marks et al. | 463/20 |

(Continued)

FOREIGN PATENT DOCUMENTS

WO WO 2007/089410 8/2007

(Continued)

*Primary Examiner* — William D Coleman
*Assistant Examiner* — Christine Enad
(74) *Attorney, Agent, or Firm* — Nixon Peabody LLP

(57) ABSTRACT

A gaming system and method for conducting a wagering game wherein a play enhancement image is displayed on a randomly selected outcome. The randomly selected outcome is enhanced by the changing of symbols in the outcome to predefined enhance symbols in a pattern in response to the play enhancement image. The play enhancement image may be an action icon traversing the display or a play enhancement image pictorially indicating a pattern in which the enhance symbols are going to form on the display.

21 Claims, 9 Drawing Sheets

U.S. PATENT DOCUMENTS

| | | | | |
|---|---|---|---|---|
| 2002/0052233 | A1 | 5/2002 | Gauselmann | 463/20 |
| 2003/0022712 | A1 | 1/2003 | Locke | 463/20 |
| 2003/0045354 | A1 | 3/2003 | Giobbi | 463/40 |
| 2003/0064802 | A1 | 4/2003 | Rodgers et al. | 463/30 |
| 2004/0033827 | A1 | 2/2004 | Gilmore et al. | 463/20 |
| 2004/0048646 | A1* | 3/2004 | Visocnik | 463/16 |
| 2004/0166929 | A1 | 8/2004 | Tarantino | |
| 2004/0198485 | A1 | 10/2004 | Loose et al. | |
| 2005/0130737 | A1 | 6/2005 | Englman et al. | 463/25 |
| 2005/0148384 | A1 | 7/2005 | Marks et al. | 463/20 |
| 2005/0250581 | A1 | 11/2005 | White et al. | |
| 2005/0282613 | A1 | 12/2005 | Pryzby et al. | |
| 2006/0030398 | A1 | 2/2006 | Hornik | |
| 2006/0063581 | A1 | 3/2006 | Harris et al. | |
| 2006/0079316 | A1 | 4/2006 | Flemming et al. | |
| 2006/0154717 | A1 | 7/2006 | Jackson | |
| 2006/0189363 | A1 | 8/2006 | Strom | |
| 2007/0060243 | A1 | 3/2007 | Gomez et al. | |
| 2007/0167216 | A1 | 7/2007 | Walker et al. | |
| 2007/0191087 | A1 | 8/2007 | Thomas et al. | |
| 2007/0270208 | A1 | 11/2007 | Caspers et al. | |
| 2007/0275778 | A1* | 11/2007 | Fong et al. | 463/20 |
| 2007/0298861 | A1 | 12/2007 | Englman et al. | |
| 2008/0032784 | A1* | 2/2008 | Englman | 463/21 |
| 2008/0064477 | A1 | 3/2008 | Fong et al. | |
| 2008/0064487 | A1 | 3/2008 | Stevens et al. | |
| 2008/0066111 | A1 | 3/2008 | Ellis et al. | |
| 2008/0076507 | A1 | 3/2008 | Wertheimer | |
| 2008/0076515 | A1 | 3/2008 | Baerlocher et al. | |
| 2008/0081688 | A1 | 4/2008 | Plowman | |
| 2008/0119261 | A1 | 5/2008 | Heymann | |
| 2008/0125208 | A1* | 5/2008 | Waters | 463/19 |
| 2009/0305770 | A1* | 12/2009 | Bennett et al. | 463/20 |
| 2010/0248811 | A1* | 9/2010 | Jaffe et al. | 463/20 |

FOREIGN PATENT DOCUMENTS

| | | |
|---|---|---|
| WO | WO 2008/039374 A2 | 4/2008 |

* cited by examiner

GAMING SYSTEM WITH PATTERNED ENHANCEMENT FEATURES

RELATED APPLICATIONS

This application is related to and claims priority to U.S. Provisional Patent Application Ser. No. 61/123,322 filed Apr. 8, 2008, titled "Gaming System With Patterned Enhancement Features," which is incorporated herein by reference in its entirety.

COPYRIGHT

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever.

FIELD OF THE INVENTION

The present invention relates generally to gaming apparatus, and methods for playing wagering games, and more particularly, to a gaming apparatus and method for playing wagering games including patterned enhancement features.

BACKGROUND OF THE INVENTION

Gaming terminals, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options.

Shrewd operators consequently strive to employ the most entertaining and exciting machines, features, and enhancements available because such machines attract frequent play and hence increase profitability to the operator. Gaming machine manufacturers have therefore provided bonus games, WILD symbol insertions and symbol changes during game play to increase player excitement.

SUMMARY OF THE INVENTION

In one aspect of the present concepts, there is provided a gaming system comprising a wager input device for receiving a wager, a display for displaying a wagering game comprised of a plurality of symbols in an array, and a controller operative to (i) detect receipt of the wager; (ii) activate a play of the wagering game by changing the symbols on the display; (iii) cause the display to display at least one play enhancement image pictorially indicating a pattern; (iv) cause the changing symbols to stop and the display to display a randomly selected outcome of the wagering game; and (v) enhance the randomly selected outcome of the wagering game in response to the at least one play enhancement image on the display by transforming each of a selected plurality of the symbols to a predefined enhance symbol, the predefined enhance symbols forming the pattern on the display.

In another aspect of the present concepts, a method of conducting a wagering game on a gaming system comprises the act of conducting the wagering game using a gaming system configured to receive inputs from the player and configured to communicate generated wagering game outcomes to the player, the gaming system comprising a user interface device configured to receive an input from the player, a display device configured to display information to the player, one or more storage devices, and one or more processors configured to execute computer instructions relating to the wagering game. The method further comprises the acts of accepting, at the user interface device, a player input and transforming the player input into electronic data signals indicative of a wager to play the wagering game, using at least one of the gaming system processors to interpret the wager from the data signals and to, at least in part, cause the recording of a digital representation of the wager in at least one of the gaming system storage devices, and using at least one of the gaming system processors to cause the display of a visual indication of the wager on the display device. The method further comprises the act of using at least one of the gaming system processors to initiate a game sequence of the wagering game on the gaming system, the game sequence comprising the acts of activating a play of the game by changing symbols of an array on a display, causing the changing symbols to stop and the display to display a randomly selected outcome of the wagering game, displaying a play enhancement image on the display, the play enhancement image pictorially indicating a pattern, and modifying the outcome of the game in response to the play enhancement image on the display by transforming each of a selected plurality of the symbols to a predefined enhance symbol, the predefined enhance symbols forming the pattern on the display. The method further includes displaying an outcome of the game sequence on the display device.

In still another aspect of the present concepts, one or more computer readable storage media are encoded with instructions for directing a gaming system to perform a method comprising displaying a play enhancement image on a display displaying a randomly selected outcome of a wagering game, the play enhancement image pictorially indicating a pattern and modifying the outcome of the game in response to the play enhancement image on the display by transforming each of a selected plurality of symbols forming the outcome of the game to a predefined symbol, the predefined symbols forming the pattern on the display.

In yet another aspect of the present concepts, a gaming system comprises means for displaying a randomly selected outcome of a wagering game, the outcome comprised of symbols in an array and means for enhancing the outcome in response to at least one play enhancement image by transforming each of a selected plurality of the symbols to a predefined enhance symbol, the at least one play enhancement image pictorially indicating a pattern, the enhance symbols forming the pattern on the display.

These and other objects and features of the present invention will become more readily apparent from the following description in which preferred and other embodiments of the invention have been set forth in conjunction with the accompanying drawing and appended claims.

Figure 1A:
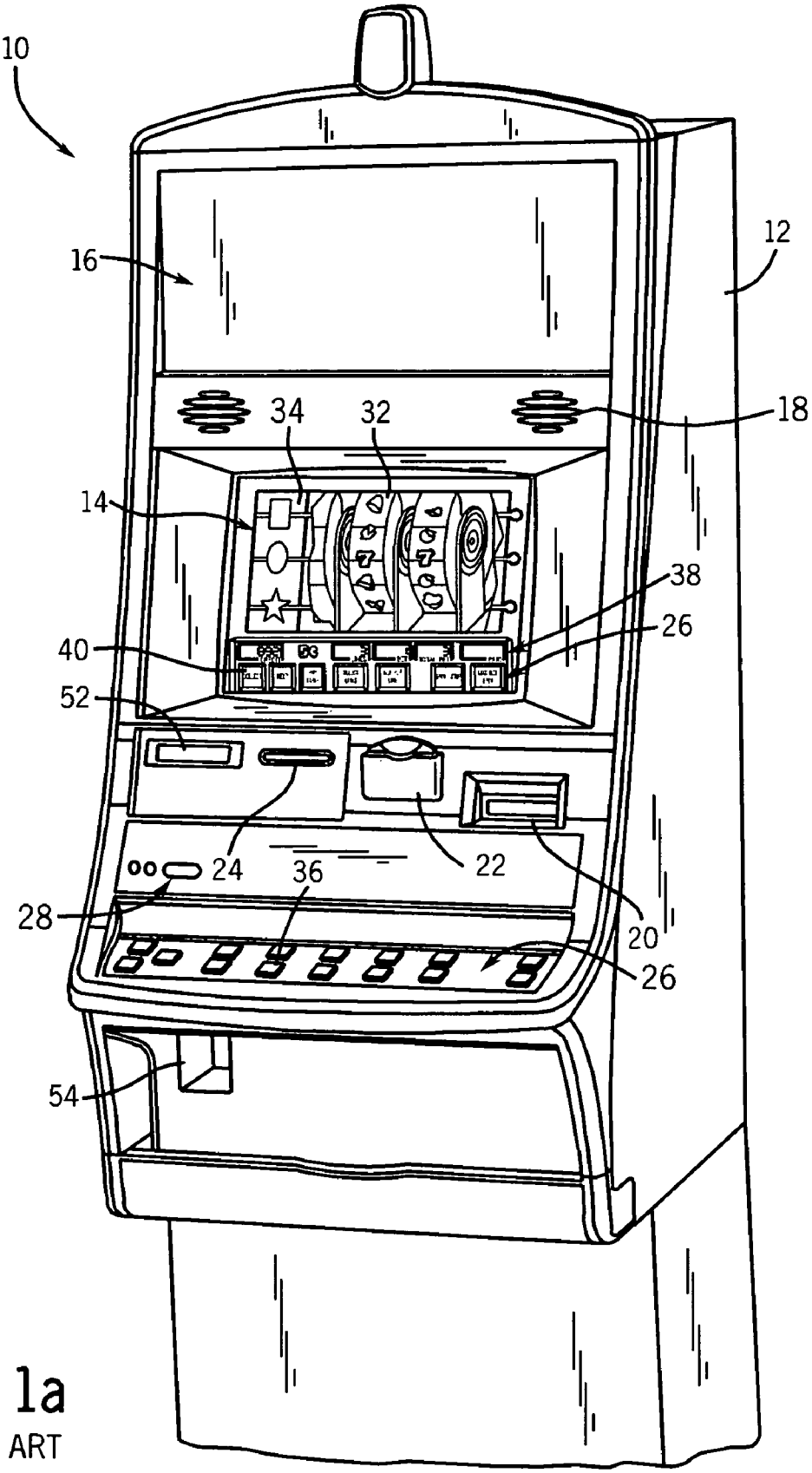
FIG. 1a PRIOR ART
FIG. 1*a* is a perspective view of a free-standing gaming terminal according to an embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 1B:
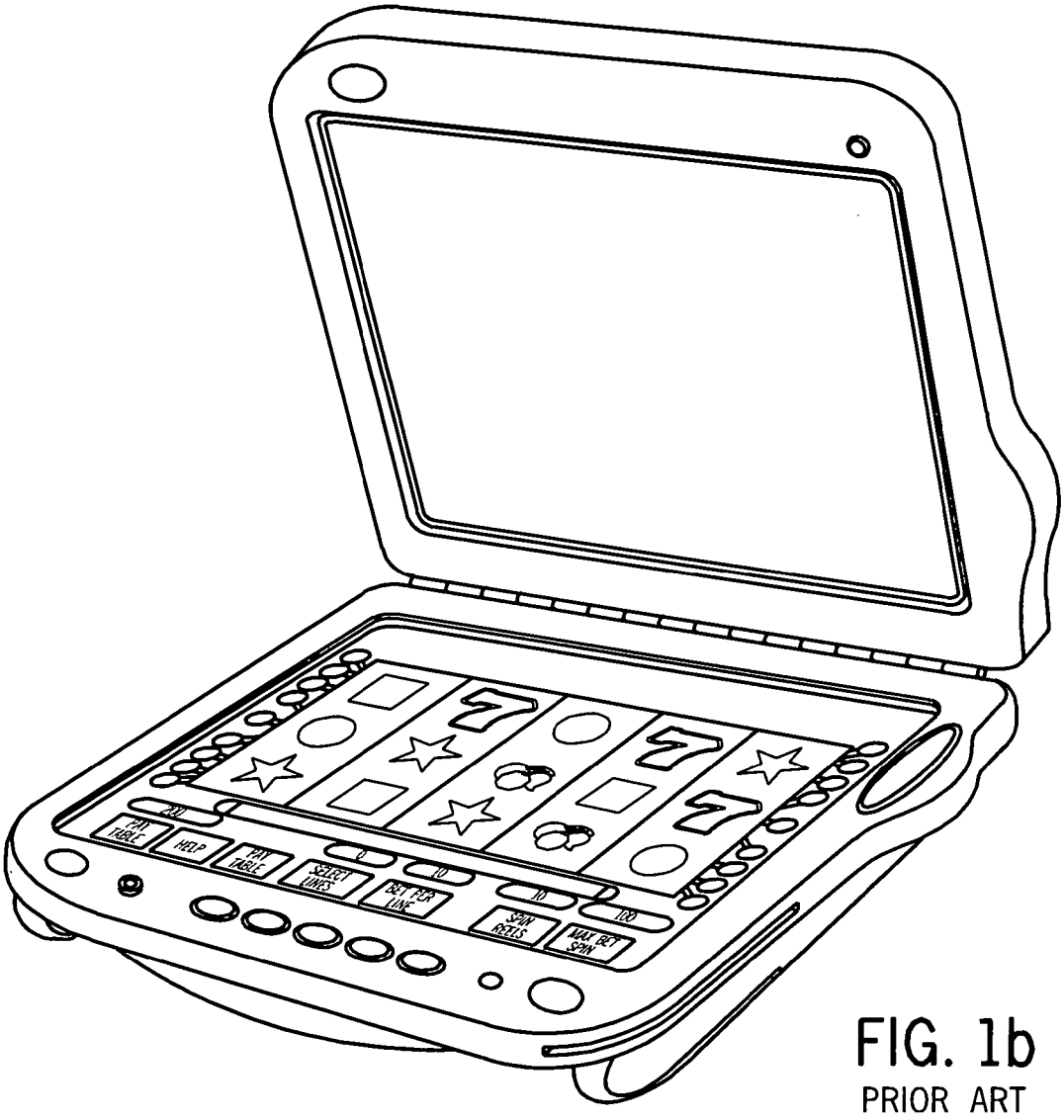
FIG. 1b PRIOR ART
FIG. 1*b* is a perspective view of a handheld gaming terminal according to an embodiment of the present invention.

Referring to FIG. 1*a*, there is shown a gaming terminal 10 similar to those used in gaming establishments, such as casinos. With regard to the present invention, the gaming terminal 10 may be any type of gaming terminal and may have varying structures and methods of operation. For example, the gaming terminal 10 may be an electromechanical gaming terminal configured to play mechanical slots, or it may be an electronic gaming terminal configured to play a video casino game, such as slots, keno, poker, blackjack, roulette, craps, etc. It should be understood that although the gaming terminal 10 is shown as a free-standing terminal of the upright type, it may take on a wide variety of other forms such as a free-standing terminal of the slant-top type, a portable or handheld device primarily used for gaming as shown in FIG. 1*b*, a mobile telecommunications device such as a mobile telephone or personal digital assistant (PDA), a counter-top or bar-top gaming terminal, or other personal electronic device such as a portable television, MP3 player, entertainment device, etc.

The illustrated gaming terminal 10 comprises a cabinet or housing 12. For output devices, the gaming terminal 10 may include a primary display area 14, a secondary display area 16, and one or more audio speakers 18. The primary display area 14 and/or secondary display area 16 may display information associated with wagering games, non-wagering games, community games, progressives, advertisements, services, premium entertainment, text messaging, emails, alerts or announcements, broadcast information, subscription information, etc. For input devices, the gaming terminal 10 may include a bill validator 20, a coin acceptor 22, one or more information readers 24, one or more player-input devices 26, and one or more player-accessible ports 28 (e.g., an audio output jack for headphones, a video headset jack, a wireless transmitter/receiver, etc.). While these typical components found in the gaming terminal 10 are described below, it should be understood that numerous other peripheral devices and other elements may exist and may be used in any number of combinations to create various forms of a gaming terminal.

The primary display area 14 may include a mechanical-reel display, a video display, or a combination thereof in which a transmissive video display in front of the mechanical-reel display portrays a video image superimposed over the mechanical-reel display. Further information concerning the latter construction is disclosed in U.S. Pat. No. 6,517,433 to Loose et al. entitled "Reel Spinning Slot Machine With Superimposed Video Image," which is incorporated herein by reference in its entirety. The video display may be a cathode ray tube (CRT), a high-resolution liquid crystal display (LCD), a plasma display, a light emitting diode (LED), a DLP projection display, an electroluminescent (EL) panel, or any other type of display suitable for use in the gaming terminal 10. The primary display area 14 may include one or more paylines 30 (see FIG. 3) extending along a portion thereof. In the illustrated embodiment, the primary display area 14 comprises a plurality of mechanical reels 32 and a video display 34 such as a transmissive display (or a reflected image arrangement in other embodiments) in front of the mechanical reels 32. If the wagering game conducted via the gaming terminal 10 relies upon the video display 34 only and not the mechanical reels 32, the mechanical reels 32 may be removed from the interior of the terminal and the video display 34 may be of a non-transmissive type. Similarly, if the wagering game conducted via the gaming terminal 10 relies upon the mechanical reels 32 but not the video display 34, the video display 34 may be replaced with a conventional glass panel. Further, the underlying mechanical-reel display may be replaced with a video display such that the primary display area 14 includes layered video displays, or may be replaced with another mechanical or physical member such as a mechanical wheel (e.g., a roulette game), dice, a pachinko board, or a diorama presenting a three-dimensional model of a game environment.

Video images in the primary display area 14 and/or the secondary display area 16 may be rendered in two-dimensional (e.g., using Flash Macromedia™) or three-dimensional graphics (e.g., using Renderware™). The images may be played back (e.g., from a recording stored on the gaming terminal 10), streamed (e.g., from a gaming network), or received as a TV signal (e.g., either broadcast or via cable). The images may be animated or they may be real-life images, either prerecorded (e.g., in the case of marketing/promotional material) or as live footage, and the format of the video images may be an analog format, a standard digital format, or a high-definition (HD) digital format.

The player-input devices 26 may include a plurality of buttons 36 on a button panel and/or a touch screen 38 mounted over the primary display area 14 and/or the secondary display area 16 and having one or more soft touch keys 40. The player-input devices 26 may further comprise technologies that do not rely upon touching the gaming terminal, such as speech-recognition technology, gesture-sensing technology, eye-tracking technology, etc.

The information reader 24 is preferably located on the front of the housing 12 and may take on many forms such as a ticket reader, card reader, bar code scanner, wireless transceiver (e.g., RFID, Bluetooth, etc.), biometric reader, or computer-readable-storage-medium interface. Information may be transmitted between a portable medium (e.g., ticket, voucher, coupon, casino card, smart card, debit card, credit card, etc.) and the information reader 24 for accessing an account associated with cashless gaming, player tracking, game customization, saved-game state, data transfer, and casino services as more fully disclosed in U.S. Patent Publication No. 2003/0045354 entitled "Portable Data Unit for Communicating With Gaming Machine Over Wireless Link," which is incorporated herein by reference in its entirety. The account may be stored at an external system 46 (see FIG. 2) as more fully disclosed in U.S. Pat. No. 6,280,328 to Holch et al. entitled "Cashless Computerized Video Game System and Method," which is incorporated herein by referenced in its entirety, or directly on the portable medium. To enhance security, the individual carrying the portable medium may be required to enter a secondary independent authenticator (e.g., password, PIN number, biometric, etc.) to access their account.

FIG. 1*b* illustrates a portable or handheld device primarily used to display and/or conduct wagering games. The handheld device may incorporate the same features as the gaming terminal 10 or variations thereof. A more detailed description of a handheld device that may be utilized with the present invention can be found in PCT Patent Application No. PCT/US2007/000792 filed Jan. 26, 2007, entitled "Handheld Device for Wagering Games," which is incorporated herein by reference in its entirety.

Figure 2:
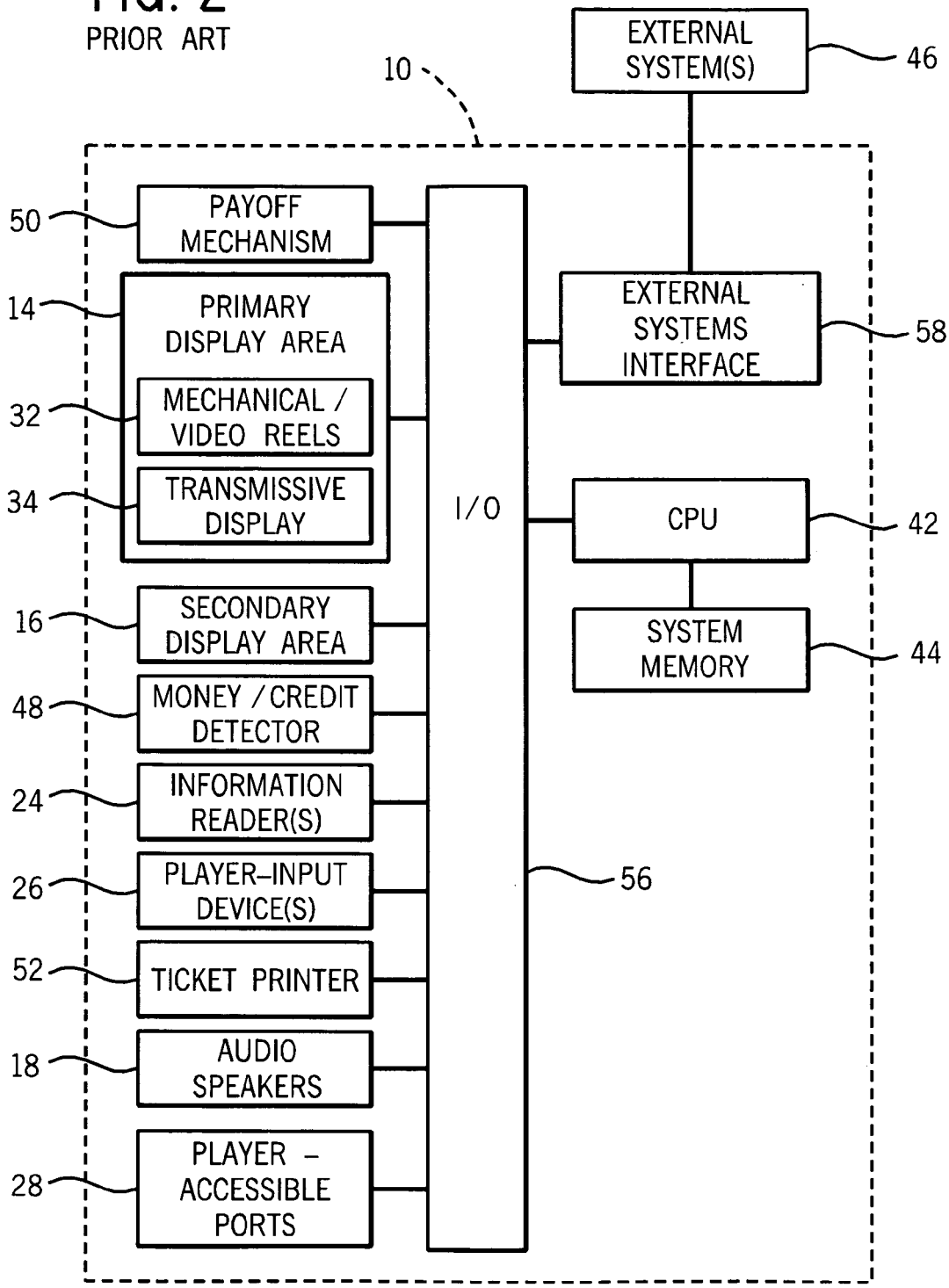
FIG. 2 PRIOR ART
FIG. 2 is a schematic view of a gaming system according to an embodiment of the present invention.

Turning now to FIG. 2, the various components of the gaming terminal 10 are controlled by a central processing unit (CPU) 42, also referred to herein as a controller or processor (such as a microcontroller or microprocessor). The CPU 42 can include any suitable processor, such as an Intel® Pentium processor, Intel® Core 2 Duo processor, AMD Opteron™ processor, or UltraSPARC® processor. To provide gaming functions, the controller 42 executes one or more game programs stored in one or more computer readable storage media in the form of memory 44 or other suitable storage device. The controller 42 uses a random number generator (RNG) to randomly generate a wagering game outcome from a plurality of possible outcomes. Alternatively, the outcome may be centrally determined using either an RNG or pooling scheme at a remote controller included, for example, within the external system 46. It should be appreciated that the controller 42 may include one or more microprocessors, including but not limited to a master processor, a slave processor, and a secondary or parallel processor. The external system 46 or the controller 42 may thus be means for displaying the wagering game outcome on the display area 14.

The controller 42 is coupled to the system memory 44 and also to a money/credit detector 48. The system memory 44 may comprise a volatile memory (e.g., a random-access memory (RAM)) and a non-volatile memory (e.g., an EEPROM). The system memory 44 may include multiple RAM and multiple program memories. The money/credit detector 48 signals the processor that money and/or credits have been input via a value-input device, such as the bill validator 20, coin acceptor 22, or via other sources, such as a cashless gaming account, etc. These components may be located internal or external to the housing 12 of the gaming terminal 10 and connected to the remainder of the components of the gaming terminal 10 via a variety of different wired or wireless connection methods. The money/credit detector 48 detects the input of funds into the gaming terminal 10 (e.g., via currency, electronic funds, ticket, card, etc.) that are generally converted into a credit balance available to the player for wagering on the gaming terminal 10. The credit detector 48 detects when a player places a wager (e.g., via a player-input device 26) to play the wagering game, the wager then generally being deducted from the credit balance. The money/credit detector 48 sends a communication to the controller 42 that a wager has been detected and also communicates the amount of the wager.

As seen in FIG. 2, the controller 42 is also connected to, and controls, the primary display area 14, the player-input device 26, and a payoff mechanism 50. The payoff mechanism 50 is operable in response to instructions from the controller 42 to award a payoff to the player in response to certain winning outcomes that might occur in the base game, the bonus game (s), or via an external game or event. The payoff may be provided in the form of money, redeemable points, services or any combination thereof. Such payoff may be associated with a ticket (from a ticket printer 52), portable data unit (e.g., a card), coins, currency bills, accounts, and the like. The payoff amounts distributed by the payoff mechanism 50 are determined by one or more pay tables stored in the system memory 44.

Communications between the controller 42 and both the peripheral components of the gaming terminal 10 and the external system 46 occur through input/output (I/O) circuit 56, which can include any suitable bus technologies, such as an AGTL+ frontside bus and a PCI backside bus. Although the I/O circuit 56 is shown as a single block, it should be appreciated that the I/O circuit 56 may include a number of different types of I/O circuits. Furthermore, in some embodiments, the components of the gaming terminal 10 can be interconnected according to any suitable interconnection architecture (e.g., directly connected, hypercube, etc.).

The I/O circuit 56 is connected to an external system interface 58, which is connected to the external system 46. The controller 42 communicates with the external system 46 via the external system interface 58 and a communication path (e.g., serial, parallel, IR, RC, 10bT, etc.). The external system 46 may include a gaming network, other gaming terminals, a gaming server, a remote controller, communications hardware, or a variety of other interfaced systems or components.

Controller 42, as used herein, comprises any combination of hardware, software, and/or firmware that may be disposed or resident inside and/or outside of the gaming terminal 10 and may communicate with and/or control the transfer of data between the gaming terminal 10 and a bus, another computer, processor, or device and/or a service and/or a network. The controller 42 may comprise one or more controllers or processors. In FIG. 2, the controller 42 in the gaming terminal 10 is depicted as comprising a CPU, but the controller 42 may alternatively comprise a CPU in combination with other components, such as the I/O circuit 56 and the system memory 44. The controller 42 is operable to execute all of the various gaming methods and other processes disclosed herein.

The gaming terminal 10 may communicate with external system 46 (in a wired or wireless manner) such that each terminal operates as a "thin client" having relatively less functionality, a "thick client" having relatively more functionality, or with any range of functionality therebetween (e.g., a "rich client"). In general, a wagering game includes an RNG for generating a random number, game logic for determining the outcome based on the randomly generated number, and game assets (e.g., art, sound, etc.) for presenting the determined outcome to a player in an audio-visual manner. The RNG, game logic, and game assets may be contained within the gaming terminal 10 ("thick client" gaming terminal), the external systems 46 ("thin client" gaming terminal), or distributed therebetween in any suitable manner ("rich client" gaming terminal).

Figure 3:
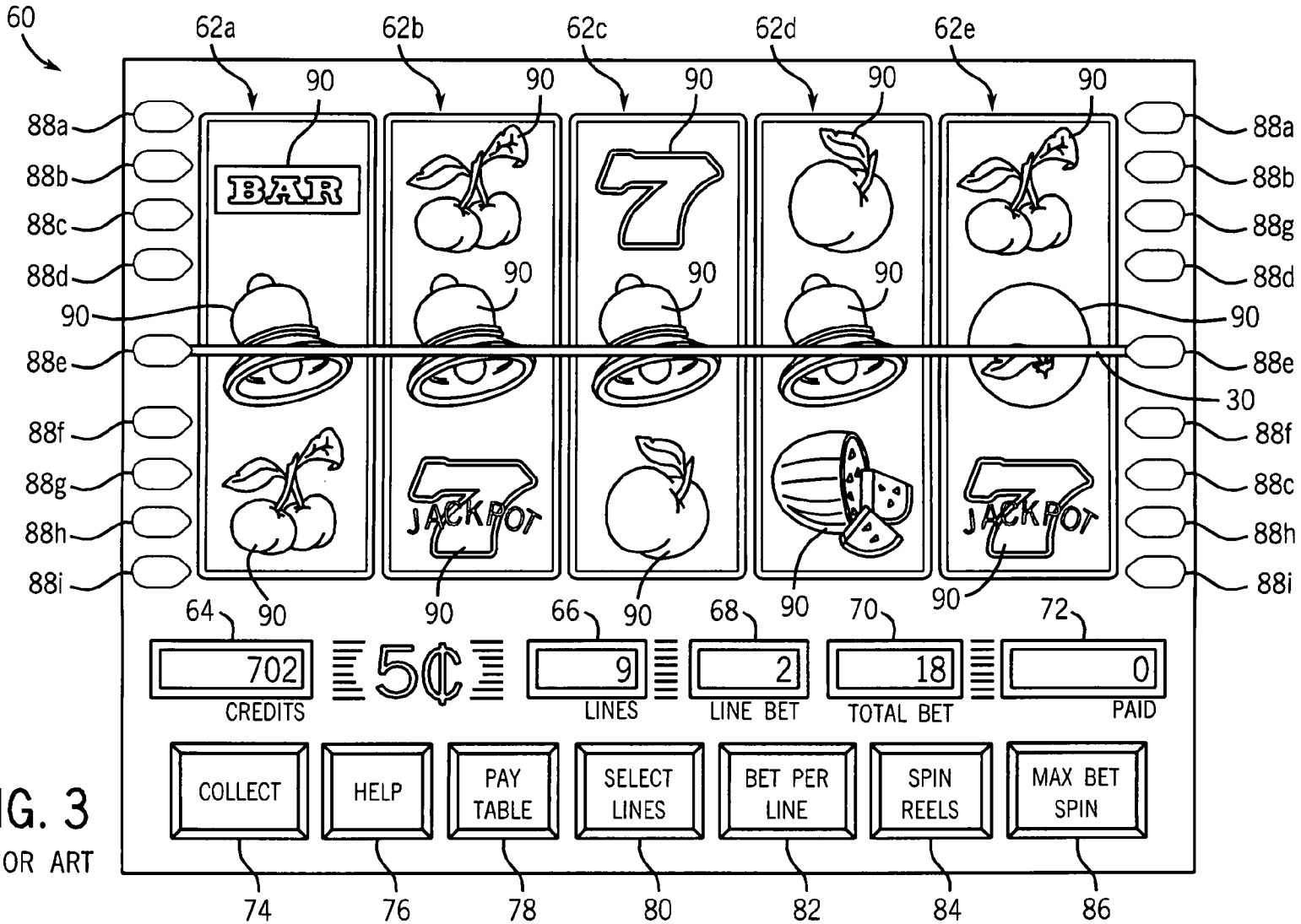
FIG. 3 PRIOR ART
FIG. 3 is an image of a game screen of a wagering game that may be displayed on a gaming terminal, according to an embodiment of the present invention.

Referring now to FIG. 3, an image of a game screen 60 adapted to be displayed on the primary display area 14 is illustrated, according to one embodiment of the present invention. A player begins play of a wagering game by providing a wager. A player can operate or interact with the wagering game using the one or more player-input devices 26. The controller 42, the external system 46, or both, in alternative embodiments, operate(s) to execute a wagering game program causing the primary display area 14 to display the wagering game that includes a plurality of visual elements.

The game screen 60 may be displayed on the primary display area 14 or a portion thereof. In FIG. 3, the game screen 60 portrays a plurality of simulated movable reels 62*a-e*. Alternatively or additionally, the game screen 60 may portray a plurality of mechanical reels. The game screen 60 may also display a plurality of game-session meters and various buttons adapted to be actuated by a player.

In the illustrated embodiment, the game-session meters include a "credit" meter 64 for displaying a number of credits available for play on the terminal; a "lines" meter 66 for displaying a number of paylines to be played by a player on the terminal; a "line bet" meter 68 for displaying a number of credits wagered (e.g., from 1 to 5 or more credits) for each of the number of paylines played; a "total bet" meter 70 for displaying a total number of credits wagered for the particular round of wagering; and a "paid" meter 72 for displaying an amount to be awarded based on the results of the particular round's wager. The user-selectable buttons may include a "collect" button 74 to collect the credits remaining in the credits meter 64; a "help" button 76 for viewing instructions on how to play the wagering game; a "pay table" button 78 for viewing a pay table associated with the basic wagering game; a "select lines" button 80 for changing the number of paylines (displayed in the lines meter 66) a player wishes to play; a "bet per line" button 82 for changing the amount of the wager which is displayed in the line-bet meter 68; a "spin reels" button 84 for moving the reels 62*a-e*; and a "max bet spin" button 86 for wagering a maximum number of credits and moving the reels 62*a-e* of the basic wagering game. While the gaming terminal 10 allows for these types of player inputs, the present invention does not require them and can be used on gaming terminals having more, less, or different player inputs.

Paylines 30 may extend from one of the payline indicators 88*a-i* on the left side of the game screen 60 to a corresponding one of the payline indicators 88*a-i* on the right side of the screen 60. A plurality of symbols 90 is displayed on the plurality of reels 62*a-e* to indicate possible outcomes of the basic wagering game. A winning combination occurs when the displayed symbols 90 correspond to one of the winning symbol combinations listed in a pay table stored in the memory 44 of the terminal 10 or in the external system 46. The symbols 90 may include any appropriate graphical representation or animation, and may further include a "blank" symbol.

Symbol combinations may be evaluated as line pays or scatter pays. Line pays may be evaluated left to right, right to left, top to bottom, bottom to top, or any combination thereof by evaluating the number, type, or order of symbols 90 appearing along an activated payline 30. Scatter pays are evaluated without regard to position or paylines and only require that such combination appears anywhere on the reels 62*a-e*. While an embodiment with nine paylines is shown, a wagering game with no paylines, a single payline, or any plurality of paylines will also work with the present invention. Additionally, though an embodiment with five reels is shown, a gaming terminal with any plurality of reels may also be used in accordance with the present invention.

Figure 4:
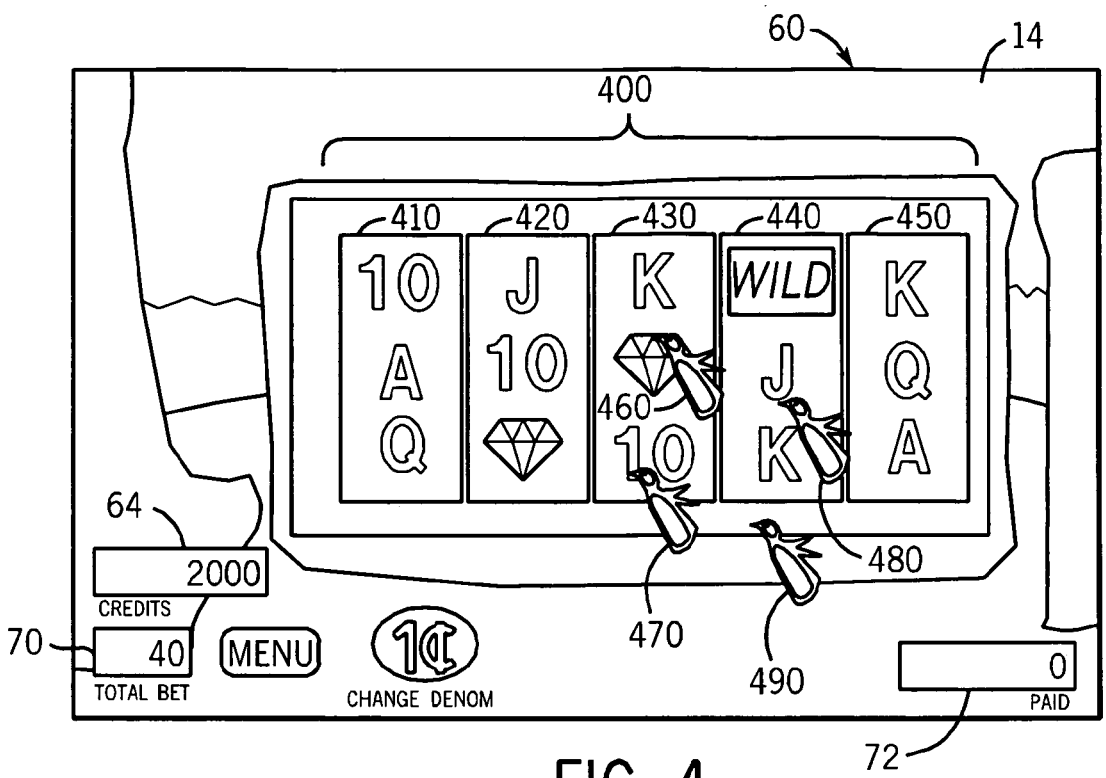
FIG. 4 is an image of game screen of a wagering game that may be displayed on a gaming terminal, according to an embodiment of the present invention.

Referring now to FIG. 4, a wagering game employing at least one play enhancement image will be described. Using the appropriate push buttons 26 and/or touch keys 30, a player begins play by selecting the number of credits (the wager) to play and the number of credits is decremented on the credit meter 64. The player may be required to select a certain number of credits, or play a certain number of credits within a predetermined time period in order to enable the play enhancement image features of the wagering game. For example, a player may be required to bet a basic wager of 25 credits and an additional side wager of 25 credits before the play enhancement image features are enabled. After selecting the appropriate credits to enable the play enhancement image features, the player then selects or activates the appropriate push button 26 or touch key 30 to begin play of the wagering game. Reels 410, 420, 430, 440 and 450 are spun, thereby changing the symbols in the array 400. Upon stopping the reels 410, 420, 430, 440 and 450, a randomly selected outcome of the wagering game is shown on the display area 14. The randomly selected outcome is enhanced in response to at least one play enhancement image on the display. The randomly selected outcome may be enhanced by any number of means, such as by the controller 42 or the external system 46. In FIG. 4, the play enhancement images are four action icons, shown as penguins 460, 470, 480 and 490. The penguins 460, 470, 480 and 490 are shown traversing the display area 14. Play enhancement features are disclosed in commonly assigned, U.S. Patent Application No. 61/123,332 to Englman et al. entitled "Gaming System With Play Enhancement Icons," which is incorporated herein by reference in its entirety.

Figure 5:
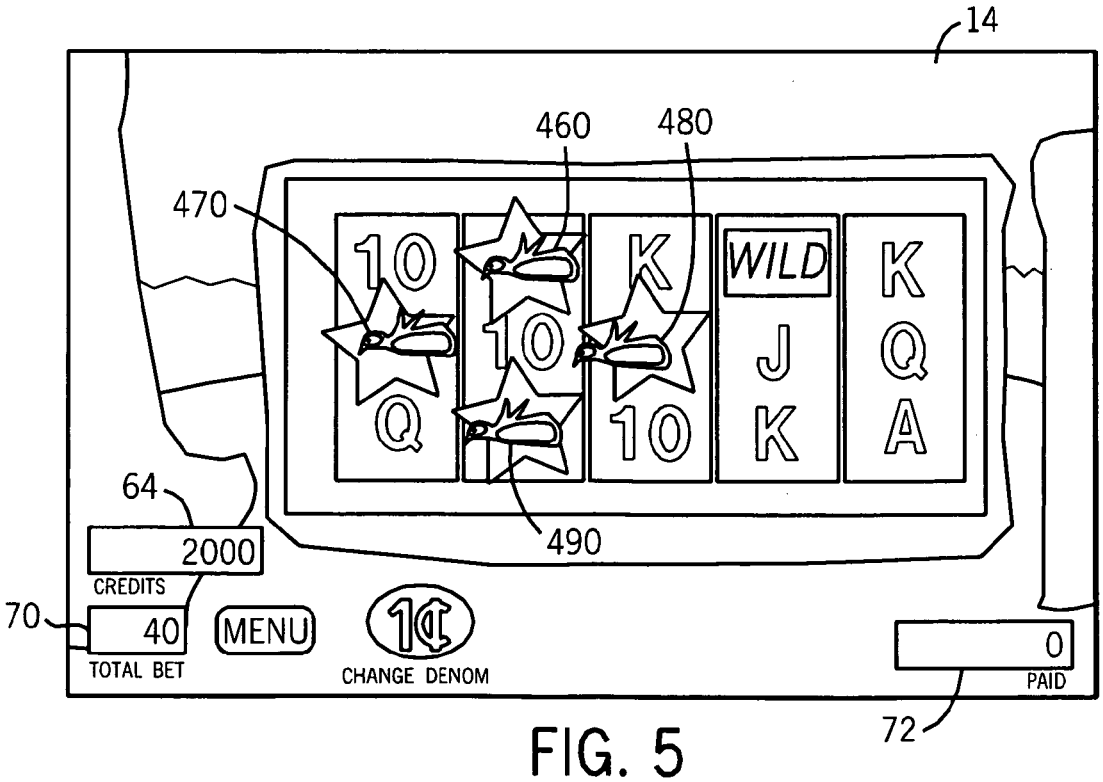
FIG. 5 is an image of a game screen of a wagering game that may be displayed on a gaming terminal, according to an embodiment of the present invention.
Figure 6:
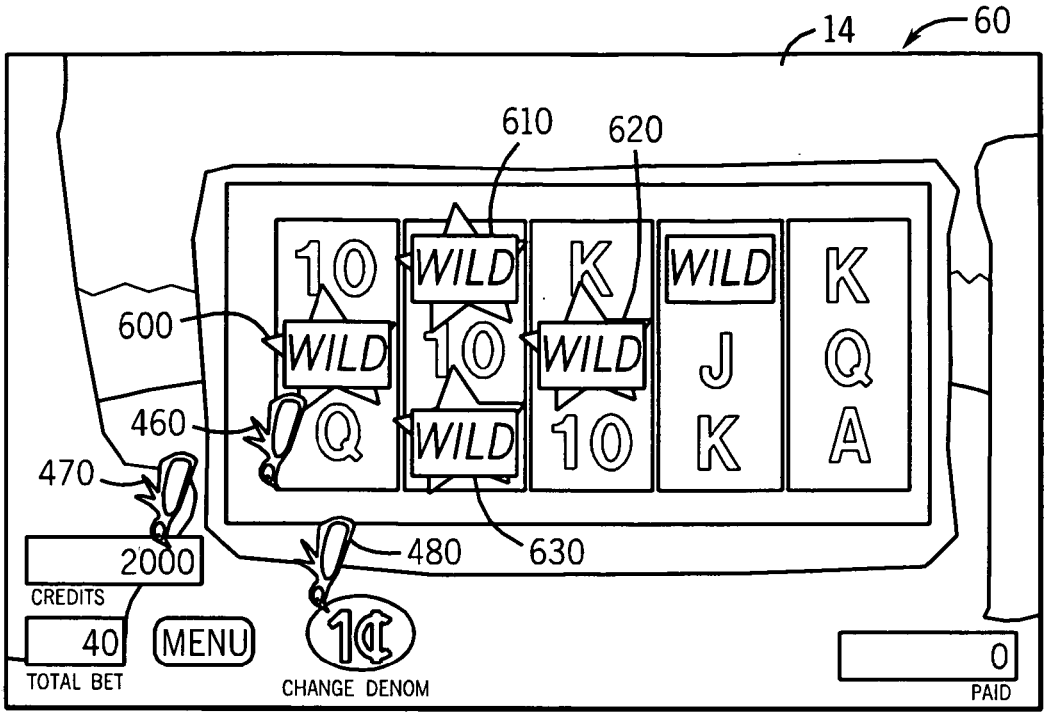
FIG. 6 is an image of a game screen of a wagering game that may be displayed on a gaming terminal, according to an embodiment of the present invention.

Referring now to FIG. 5, the penguins 460, 470, 480 and 490 have each landed on a symbol in the array 400. In FIG. 6, the penguins 460, 470, 480 and 490 have turned each of their respective symbols into a predefined enhance symbol, such as WILD symbols 600, 610, 620 and 630 and are heading off of the display area 14. The WILD symbols 600, 610, 620 and 630 form a pattern on the display area 14 which, in this instance, is a diamond shape. Other shapes may be employed, such as a square shape, a V-shape and an X-shape. Although the penguins 460, 470, 480 and 490 are described herein as changing their respective symbols after the reels have stopped spinning, it should be readily understood that the penguins 460, 470, 480 and 490 may traverse the display area 14 and change symbols at any time during the playing of the wagering game.

Figure 7:
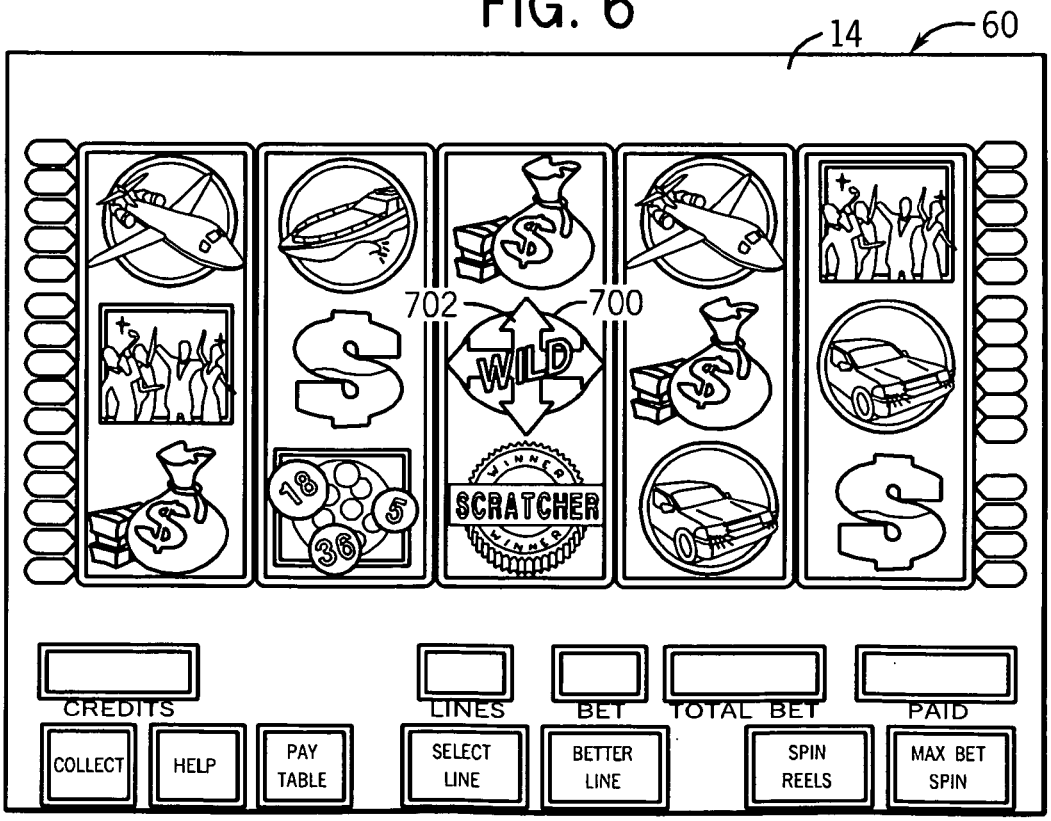
FIG. 7 is an image of a game screen of a wagering game that may be displayed on a gaming terminal, according to an embodiment of the present invention.
Figure 8:
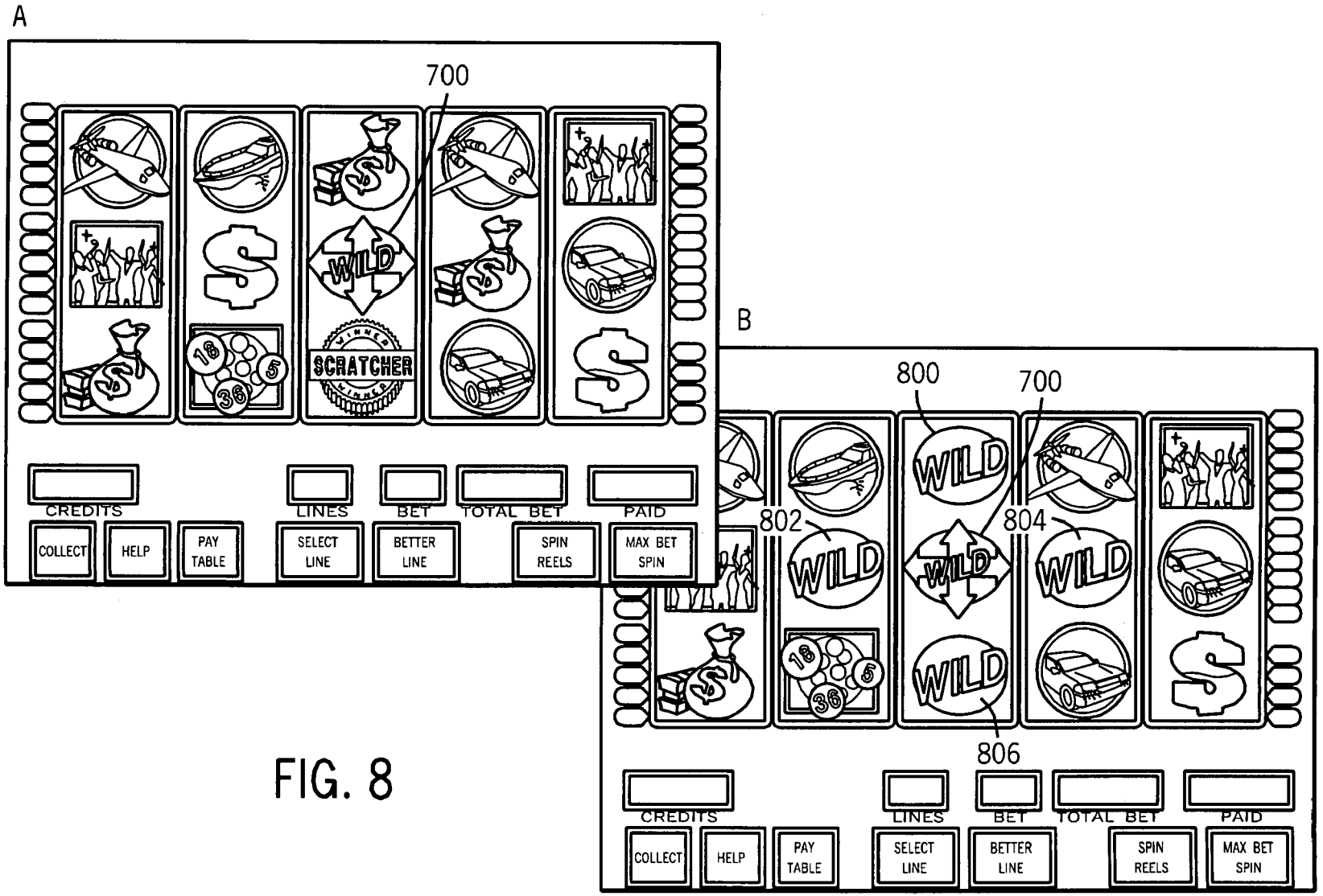
FIG. 8 shows images of game screens of a wagering game that may be displayed on a gaming terminal, according to an embodiment of the present invention.

Referring to FIG. 7, a randomly selected outcome of a wagering game is shown on the display 14 comprised of a pattern enhancement symbol 700, which is shown as a WILD symbol that has a graphical indication, or visual representation, of a pattern on its face. The pattern enhancement symbol 700 may be located at any position in the array of symbols. The symbol 700 shown in FIG. 7 has a cross-shape 702 picture, or image, which is a pictorial, or visual, indication of the pattern in which the predefined enhance symbols are going to be placed on the display area 14. In FIG. 8, the transition from screen A as shown in FIG. 7 to screen B is illustrated. In screen B, the pattern enhancement symbol 700 has caused four of the symbols 800, 802, 804 and 806 to be changed into WILD symbols in a cross-shape pattern in accordance with the cross-shape 702 visual representation of the pattern on the symbol 700. The outcome is now evaluated with the predefined enhances symbols to determine the winnings, if any, of the player.

Figure 9:
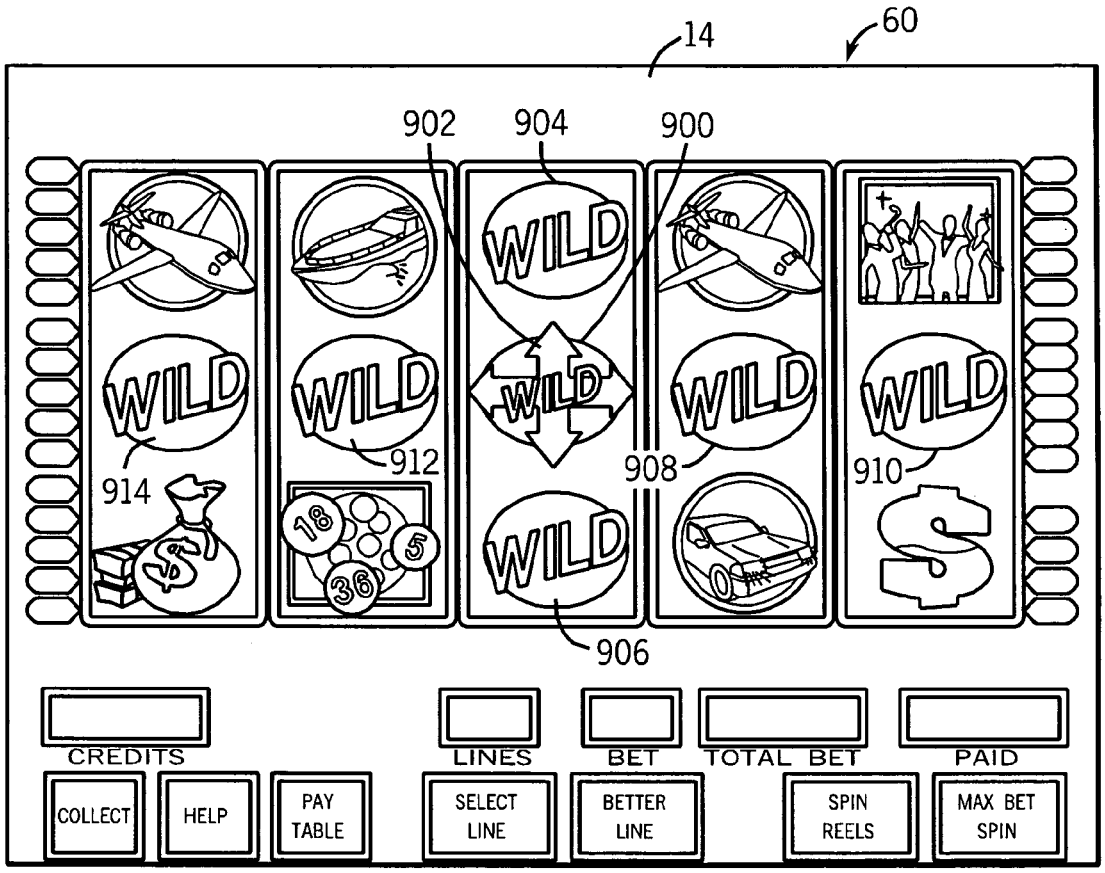
FIG. 9 is an image of a game screen a wagering game that may be displayed on a gaming terminal, according to an embodiment of the present invention.

Referring to FIG. 9, the WILD symbols have been extended the width of the display 14 by changing symbols 904, 906, 908, 910, 912 and 914 into WILD symbols in response to the play enhancement symbol 900. The play enhancement symbol 900, or play enhancement image, has a cross-shaped 902 visual representation of the pattern in which the WILD symbols are placed on the display area 14. The play enhancement image therefore pictorially indicates the pattern.

Figure 10:
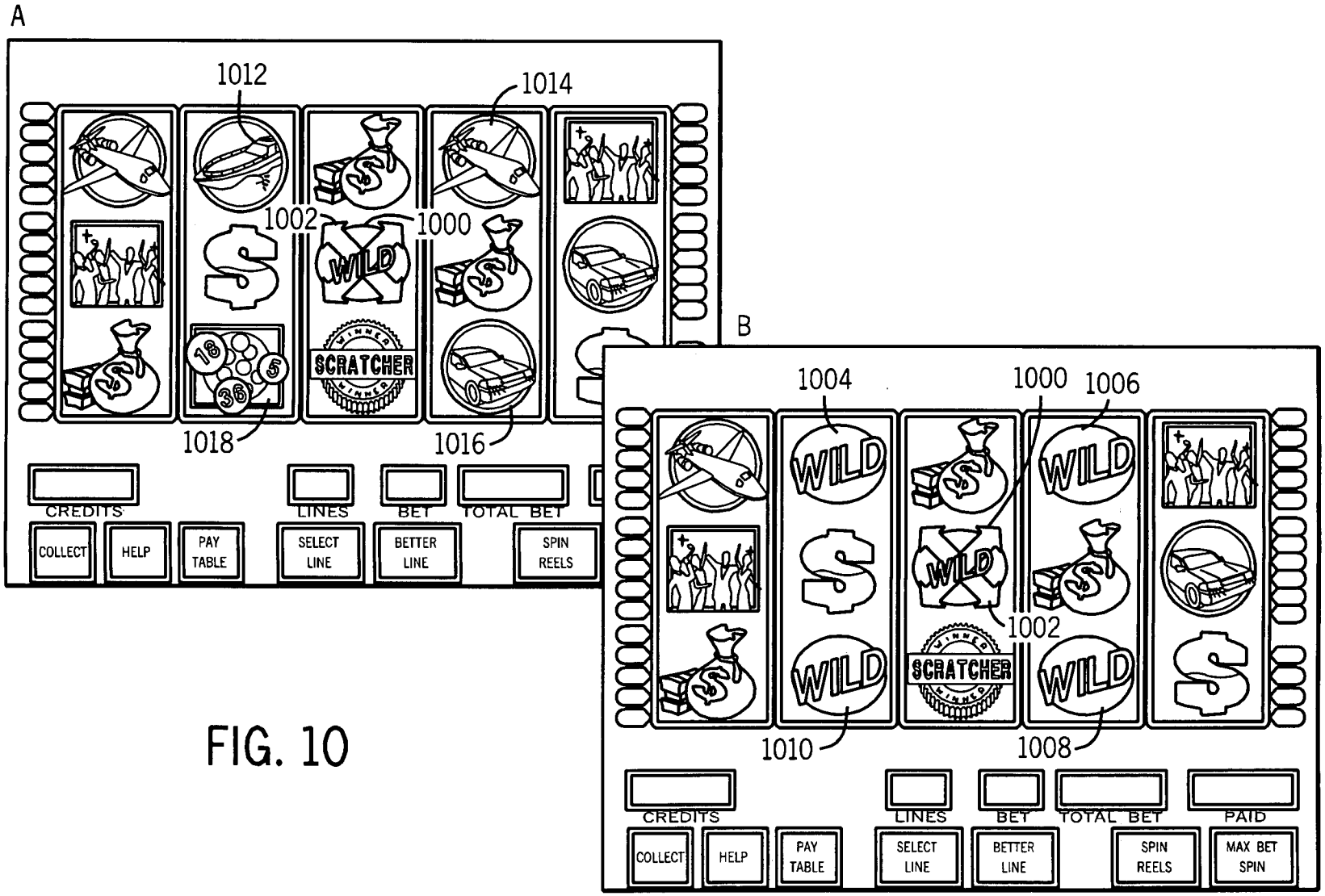
FIG. 10 shows images of game screens of a wagering game that may be displayed on a gaming terminal, according to an embodiment of the present invention.

Referring to FIG. 10, an X-shape pattern of predefined enhance symbols is illustrated. Screen A shows a randomly selected outcome of a wagering game in the display area 14 comprised of a play enhancement symbol 1000 having an X-shape representation 1002. The X-shape representation 1002 is a pictorial or visual indication of a pattern in which predefined enhance symbols will form on the display area 14. In screen B, a plurality of predefined enhance symbols 1004, 1006, 1008 and 1010 have replaced prior respective symbols 1012, 1014, 1016 and 1018 as shown in screen A. The predefined enhance symbols 1004, 1006, 1008 and 1010, along with the play enhancement symbol 1000 form an X-shape on the display area 14. As will be apparent to those skilled in the art, a number of different patterns, or shapes, may be employed. For example, a diamond shape, a V-shape, a square-shape or others may be employed.

One or more computer readable storage media may be provided which is encoded with instructions for directing a gaming system to perform the various functions described herein. The media may direct the gaming system to display a play enhancement image on a display displaying a randomly selected outcome of a wagering game and modifying the outcome of the game in response to the play enhancement image on the display by transforming each of a selected plurality of symbols forming the outcome of the game to a predefined symbol, the predefined symbols forming a pattern on the display.

Each of these embodiments and obvious variations thereof is contemplated as falling within the spirit and scope of the claimed invention, which is set forth in the following claims.

What is claimed is:

1. A gaming system comprising:

a wager input device for receiving a wager;

a display for displaying a wagering game comprised of a plurality of symbols in an array; and a controller operative to:

(i) detect receipt of the wager;

(ii) activate a play of the wagering game by changing the symbols on the display;

(iii) cause the display to display at least one play enhancement image pictorially indicating a pattern;

(iv) cause the changing symbols to stop and the display to display a randomly selected outcome of the wagering game; and (v) enhance the randomly selected outcome of the wagering game in response to the at least one play enhancement image on the display by transforming each of a selected plurality of the symbols of the randomly selected outcome to a predefined enhance symbol, the predefined enhance symbols forming the pattern on the display.

2. The gaming system of claim 1 wherein the pattern is a diamond shape.

3. The gaming system of claim 1 wherein the pattern is a square shape.

4. The gaming system of claim 1 wherein the pattern is a V-shape.

5. The gaming system of claim 1 wherein the pattern is an X-shape.

6. The gaming system of claim 1 wherein the predefined enhance symbol is a WILD symbol.

7. The gaming system of claim 1 wherein the at least one play enhancement image comprises an action icon traversing the display.

8. The gaming system of claim 1 wherein the at least one play enhancement image comprises a pattern enhancement symbol included among the plurality of symbols, the pattern enhancement symbol including an indication of the pattern on a face of the pattern enhancement symbol.

9. The gaming system of claim 8 wherein the pattern enhancement symbol comprises a WILD symbol which graphically indicates the pattern.

10. A method of conducting a wagering game on a gaming system, the method comprising: conducting the wagering game using a gaming system configured to receive inputs from the player and configured to communicate generated wagering game outcomes to the player, the gaming system comprising, a user interface device configured to receive an input from the player;

a display device configured to display information to the player;

one or more storage devices; and one or more processors configured to execute computer instructions relating to the wagering game; and accepting, at the user interface device, a player input and transforming the player input into electronic data signals indicative of a wager to play the wagering game;

using at least one of the gaming system processors to interpret the wager from the data signals and to, at least in part, cause the recording of a digital representation of the wager in at least one of the gaming system storage devices;

using at least one of the gaming system processors to cause the display of a visual indication of the wager on the display device;

using at least one of the gaming system processors to initiate a game sequence of the wagering game on the gaming system, the game sequence comprising the acts of activating a play of the game by changing symbols of an array on a display, causing the changing symbols to stop and the display to display a randomly selected outcome of the wagering game, displaying a play enhancement image on the display, the play enhancement image pictorially indicating a pattern, and modifying the outcome of the game in response to the play enhancement image on the display by transforming each of a selected plurality of the symbols to a predefined enhance symbol, the predefined enhance symbols forming the pattern on the display; and displaying an outcome of the game sequence on the display device.

11. The method of claim 10 wherein the play enhancement image is an action icon which traverses the display changing each of the selected plurality of the symbols to the predefined enhance symbols.

12. The method of claim 10 wherein the play enhancement image is a pattern enhancement symbol included among the symbols, the pattern enhancement symbol pictorially indicating the pattern the predefined symbols will form on the display.

13. The method of claim 12 wherein the predefined symbol is a WILD symbol.

14. The method of claim 12 wherein the pattern is a diamond shape.

15. The method of claim 12 wherein the pattern is an X-shape.

16. The method of claim 12 wherein the pattern is a V-shape.

17. The method of claim 12 wherein the pattern enhancement symbol comprises a visual representation of the pattern.

18. A gaming system comprising:

a wager input device for receiving a wager;

a display for displaying a wagering game comprised of a plurality of symbols in an array; and a controller operative to:

(i) cause the display to display a randomly selected outcome of the wagering game, the randomly selected outcome including a plurality of symbols, each of the plurality of symbols being displayed in a respective one of a plurality of display positions on the display, the plurality of symbols including a pattern enhancement symbol, the pattern enhancement symbol including an indication of a pattern on a face of the pattern enhancement symbol; and (ii) enhance the randomly selected outcome of the wagering game in response to the pattern enhancement symbol on the display by transforming each of a selected plurality of the symbols of the randomly selected outcome to a predefined enhance symbol, the display positions of the selected plurality of the symbols forming the pattern on the display with respect to the display position of the pattern enhancement symbol.

19. The gaming system of claim 18 wherein the predefined symbol is a WILD symbol.

20. The gaming system of claim 18 wherein the pattern is a diamond shape.

21. The gaming system of claim 18 wherein the pattern is an X-shape.

* * * * *